US006702928B2

(12) United States Patent
Aho

(10) Patent No.: US 6,702,928 B2
(45) Date of Patent: Mar. 9, 2004

(54) PRESS ROLL

(75) Inventor: Erkki Aho, Elimäki (FI)

(73) Assignee: Vaahto Oy, Elimaki (FI)

( * ) Notice: Subject to any disclaimer, the term of this patent is extended or adjusted under 35 U.S.C. 154(b) by 0 days.

(21) Appl. No.: 10/185,094

(22) Filed: Jul. 1, 2002

(65) Prior Publication Data

US 2003/0024676 A1 Feb. 6, 2003

(30) Foreign Application Priority Data

Jul. 5, 2001 (FI) ..... 20011472
Apr. 10, 2002 (FI) ..... 20020683

(51) Int. Cl.[7] ..... D21F 3/00

(52) U.S. Cl. ..... 162/358.3; 162/358.4; 162/361; 162/270; 492/4; 492/20; 492/45; 492/47

(58) Field of Search ..... 492/4, 20, 45, 492/47; 162/272, 358.3, 358.4, 361

(56) References Cited

U.S. PATENT DOCUMENTS 4,625,376 A 12/1986 Schiel et al.
4,878,281 A 11/1989 Flamig et al. ..... 492/20
4,975,152 A 12/1990 Filzen et al. ..... 162/358.3
5,098,523 A 3/1992 Ilmarinen et al. ..... 162/358.3
5,556,514 A 9/1996 Didier ..... 162/358.3
5,700,357 A 12/1997 Didier ..... 162/358.3
5,904,813 A * 5/1999 Bengtsson et al. ..... 162/358.3

FOREIGN PATENT DOCUMENTS

DE 297 02 362 U1 6/1997
JP 10-158987 6/1998

* cited by examiner

*Primary Examiner*—Steven P. Griffin
*Assistant Examiner*—Mark Halpern
(74) *Attorney, Agent, or Firm*—Birch, Stewart, Kolasch & Birch, LLP

(57) ABSTRACT

The invention relates to a press roll (1) comprising a flexible rotating endless-loop blanket (3) of a liquid-impervious material, two disc-shaped roll heads (4, 5), and a clamp element (14) filled with a pressurized medium for clamping the lateral rims (21) of the blanket (3) to the respective ones (4, 5) of the roll heads. The invention is implemented by adapting between the pressurized-medium-filled clamp element (14) and the blanket (3) an annular ring (18) serving to press the rim of the blanket (3) during the pressurization of said clamp element against the inner rim surface (15) of a sector plate (7) and, respectively, serving to contract the clamp element (14) when the pressure of the clamp element (14) is removed or lowered.

6 Claims, 4 Drawing Sheets

C - C

A - A

B - B

C - C

PRESS ROLL

The present invention relates to a press roll and, more particularly, to a.

A press roll which comprises a flexible rotating mantle of a liquid-impervious blanket material, two disc-shaped roll heads and a clamp element with a locking element for engaging the lateral rims of the endless-loop blanket to the respective roll heads. In addition to the above-mentioned components, a press roll according to the invention includes at least one rigidly mounted nonrotating roll support beam that extends axially through the interior of the endless-loop blanket and has a stub shaft mounted at its both ends, at least one press shoe resting on the roll support beam and having a concave top face, and means for compressing the concave top face of the shoe against the flexible blanket so as to form a nip zone in cooperation with the backing roll.

In as much the inner surface of the blanket must be lubricated to reduce wear of the blanket on its interior side, the gap between the blanket and the roll heads must be made liquid-tight. Without this precaution, a risk of web contamination at the press roll could arise. Hence, it is also extremely important that the lateral rims of the blanket are connected to the roll heads in a liquid-tight fashion. Moreover, it is important that this connection can be engaged and disengaged quickly, because normal wear of the blanket necessitates blanket replacement at regular intervals, whereby the time consumed in replacing the blanket should be made maximally short.

For instance in patent application U.S. Pat. No. 4,975,152 is disclosed an arrangement for engaging an endless-loop blanket in a liquid-tight sealed fashion to the press roll heads. According to the teaching of the publication, the lateral edge of the endless-loop blanket is secured to the head of the press roll by means of a hose-like inflatable annular seal element made from a flexible material. The head comprises a head body wherein the securing element is mounted, complemented with a two-part securing sector member which is pivotally mounted so as to be rotatable into a position facing the exterior side of the securing element. The interior of the securing element is pressurizable so as to expand the securing element, whereby the endless-loop blanket adapted between the securing element and the securing sector member is compressed therebetween thus establishing a liquid-tight joint. According to the teaching of the publication, the securing sector member may include barbs directed radially inwardly toward the endless-loop blanket in order to improve the clamping of the blanket. The arrangement disclosed in the publication, however, is problematic under disturbance situations in as much the pressure applied to the interior of the securing element may then fall or even disappear entirely, whereby the endless-loop blanket may detach from the heads thus causing the production to halt. Also the barbs may damage the endless-loop blanket. If a damage to the blanket occurs, the lubricating oil can soil the machinery and its surroundings in a problematic manner.

In patent publication U.S. Pat. No. 5,700,357 is disclosed an arrangement aiming to overcome the above kind of detachment of the endless-loop blanket during a disturbance situation. According to the teaching of the publication, the blanket is secured using an annular hose-like seal element filled with pressurized air in combination with an array of mechanically-driven wedged clamp segments by means of which the blanket is pressed against a circumferential clamp ring and barbs directed therefrom radially inwardly toward the rim of the blanket.

Nevertheless, the arrangements taught by patent publications U.S. Pat. No. 4,975,152 and U.S. Pat. No. 5,700,357 still remain problematic in regard to the accuracy of blanket alignment at the ends of the press roll, that is, at the roll heads. Such inaccuracies in the blanket alignment may cause uneven and unstable run of the press roll blanket and increase its wear.

In patent publication Fl 87094 is disclosed an alternative arrangement for clamping the blanket to the roll heads. Herein, the edge portion of the blanket is bent radially inward and clamped by means of a clamp ring against a seal surface of the roll head end wall. The publication also teaches that bending of the blanket edge portion is made easier by way of providing the blanket edge with a plurality of indents that thus form tongues therebetween. Each one of the tongues has in the tongue area a hole that can be aligned with a clamp element, whereby the tongue under a tensional stress will stay clamped at a given distance from the center axis of the roll. However, this kind of blanket clamping arrangement is handicapped by the large number of tongues to be clamped that makes blanket replacement a time-consuming operation. Furthermore, the blanket is subjected to an extremely high stress at the bending point of the tongues in a manner that may shorten its service life. Also the blanket clamping holes and indents are subjected to stresses that may cause damage to the blanket and induce uneven tension along the circumferential rim of the blanket.

From patent publication Fl 96525 is further known an arrangement, wherein an annularly wedged member is used for clamping the blanket by way of tensioning the blanket against a clamp surface. This kind of clamping arrangement is problematic in as much the wedged member imposes a shearing stress on the blanket material in a manner that may shorten the blanket service life. Furthermore, the blanket may crimple problematically during its replacement.

It is an object of the present invention to eliminate or at least reduce the problems hampering the above-described prior-art arrangements.

It is a further object of the present invention to provide a press roll having its endless-loop blanket clamped to the roll heads in a liquid-tight and reliable fashion. It is still another object of the present invention to provide a press roll offering a rapid and easy replacement of the endless-loop blanket. It is still a further object of the present invention to provide a press roll, wherein a malfunction of its clamp element cannot invoke a major disturbance situation due to defective clamping of the endless-loop blanket by allowing the blanket to detach from the roll heads.

In order to realize the above-mentioned goals, a press roll according to the invention is principally characterized by having between the pressurized-medium-filled clamp element and the endless-loop blanket adapted an elastic annular element that during the pressurization of the clamp element presses the blanket against the inner rim surface of the sector plates and, at the decompression or reduction of the pressure of the clamp element, keeps the clamp element under external compression. The roll head construction comprising a plurality of adjacent sector plates reduces the manufacturing cost of the roll head.

A preferred embodiment of the invention is characterized in that the sector plate incorporates one or move grooves against which the blanket is arranged to be compressively sealed/clamped to the roll head.

Another preferred embodiment of the invention is characterized in that the pressurized-medium-filled clamp element is an annular clamp means fillable with a pressurized liquid medium.

A still another preferred embodiment of the invention is characterized in that the sector plates are locked to the roll head body in the radial direction of the inner wall thereof by means of an annularly wedged tongue-and-groove joint.

A further another preferred embodiment of the invention is characterized in that the roll head includes a clamp means adapted movable in the radial direction of the roll head so as to cooperate with the endless-loop blanket for clamping the rim of the blanket to the roll head, said clamp means comprising a gearwheel rotatable from the exterior side of the roll head and a toothed locking pin cooperating with the teeth of the gearwheel so as to be movable in the radial direction of the roll head by means of said gearwheel for engaging the pin into a locking hole and disengaging the pin from said locking hole.

One of the major advantages of a press roll according to the invention is the highly reliable clamping of the blanket to the roll head. The clamp means that clamp the endless-loop blanket to the roll head retain the blanket in place also during a malfunction of the pressurized-medium-filled clamp element, whereby costly situations caused by an entirely detached blanket cannot arise. Moreover, the press roll according to the invention offers a blanket-clamping system free from sharp points causing wear of the endless-loop blanket and no unevenly distributed forces are imposed on the blanket in as much the blanket is primarily clamped by a pressurized-medium-driven clamp means, whereby the locking elements serve as securing members of blanket clamping only.

Furthermore, the press roll according to the invention offers the benefits of easy and quick replacement of the blanket. The locking elements used in the press roll according to the invention secure that the blanket will be aligned in a correct position resting in a balanced manner on both roll heads.

BRIEF DESCRIPTION OF THE DRAWINGS

In the following, the invention is described in more detail by making reference to the appended drawings in which.

DETAILED DESCRIPTION

Figure 1:
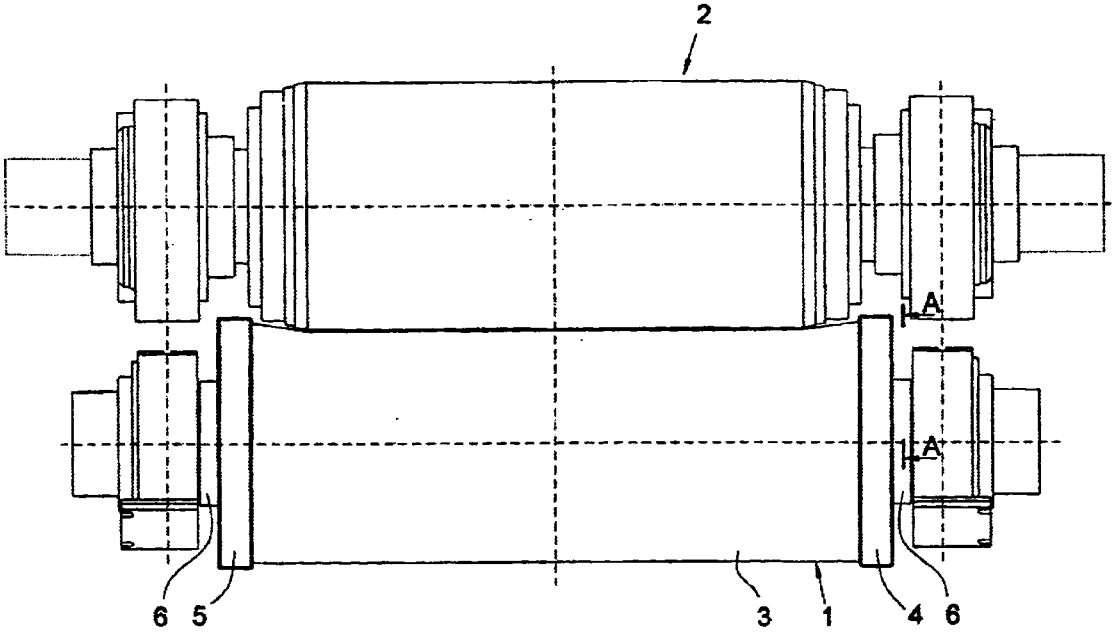
FIG. 1 is a diagrammatic view of a press roll according to the invention cooperating with a backing roll.

In FIG. 1 is shown an exemplary embodiment according to the invention of a press roll 1 with its backing roll 2 as seen in the machine direction, whereby said rolls in a paper- or boardmaking machine form an extended-nip press wherein the web is passed into a nip between the press roll 1 rotating under its backing roll 2 in order to press water away from the web. The backing roll may be a heated or nonheated roll. The press roll 1 comprises a tubular endless-loop blanket 3 made from an flexible and liquid-impervious material that is clamped in an air- and liquid-tight fashion to the roll heads 4 and 5 by means of a clamp element as will be described later in the text. The roll heads are rotatably journaled in bearings on support members 6 that have a circular cross section and are fitted in an air- and liquid-tight fashion into the center holes of the roll heads. The roll heads are adapted axially movable relative to the support members.

Obviously, an extended-nip press and its press roll also include other members and elements omitted from the diagrams for greater clarity. For instance, the press roll incorporates a shoe adapted to coincide with the center axis of the backing roll so that the shoe can be loaded by actuators against the backing roll to form a nip. The shoe and its actuators are supported by an internal frame that typically is mounted stationary on support beams 6. Other ancillary equipment not shown in the diagrams are, e.g., a lift assembly for the backing roll, means for feeding a coolant and lubricant onto the top face of the shoe, etc. Furthermore, the extended-nip press may be constructed to have an inverted configuration wherein the press roll located above the backing roll.

Figure 2:
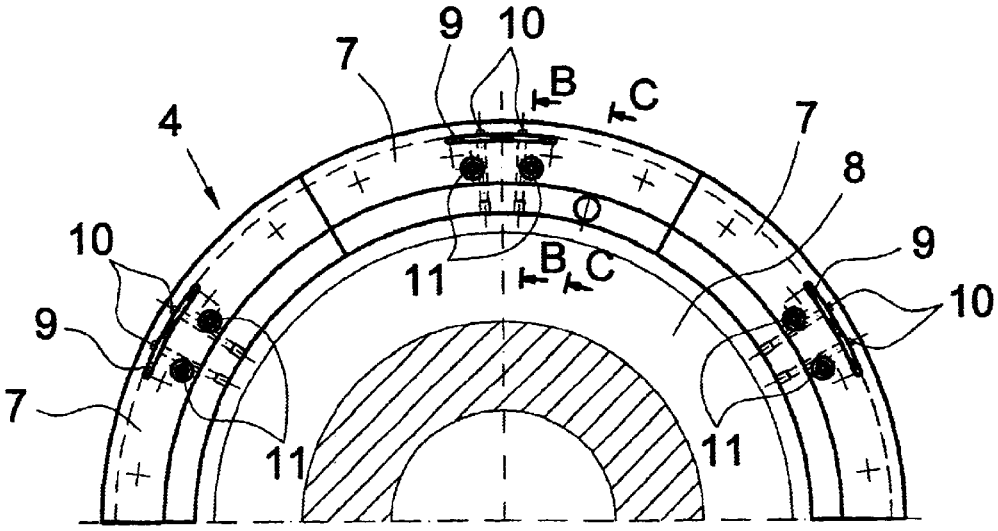
FIG. 2 is a partially sectional view of the press roll of FIG. 1 taken along plane A—A.

In FIG. 2 is shown a roll head 4 of the press roll of FIG. 1. In the fashion illustrated in the diagram, the outer rim of the roll head comprises a plurality of sector plates 7 that are mounted on the body 8 of the roll head by screws (not shown in the diagram). The sector plates include a locking hole 9 passing through the sector plate for locking the lateral rim of the blanket to the sector plate. Each pair of the locking holes is adapted to accommodate two pin-shaped locking elements 10 shown by a dashed line in the diagram. In a rack-and-pinion fashion, the toothed locking elements 10 are adapted movable from the exterior side of the roll head in the radial direction of the roll head by way of rotating a gearwheel 11 functionally cooperating with the locking element.

Figure 3:
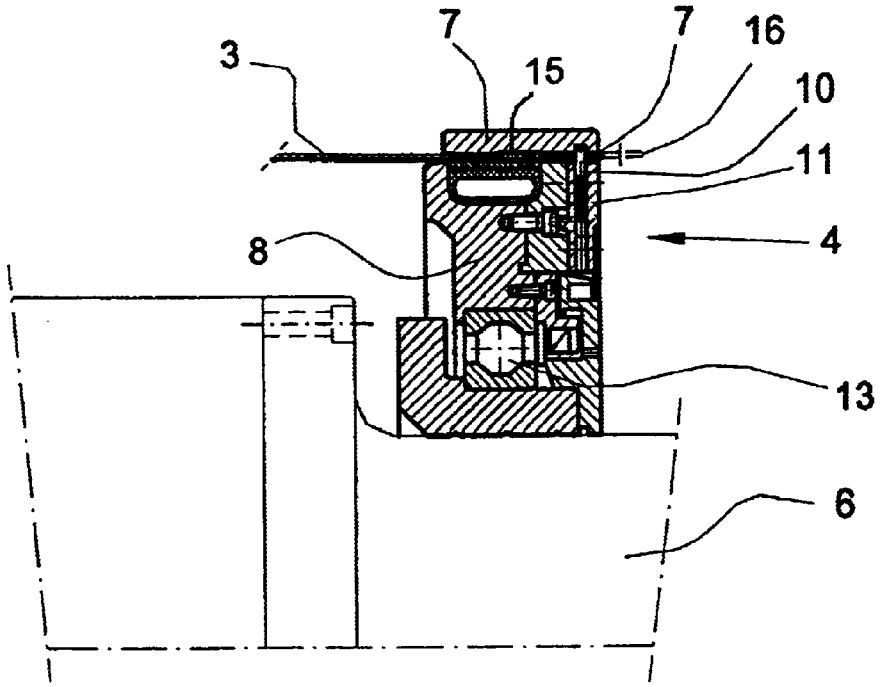
FIG. 3 is a sectional view of FIG. 2 taken along plane B—B.

FIG. 3 shows a cross-sectional view of a roll head taken along plane B—B. The roll head 4 is rotatably mounted on a support member 6 by an annular bearing element 13. In the exemplary embodiment of FIG. 3, the bearing element is a ball bearing. Alternative bearing arrangements include, e.g., some other type of rolling bearing or, optionally, a sliding bearing with sleeve or spherical journal surfaces can be used.

The roll head comprises a body 8 and sector plates 7 connected to the body by screws. The body 8 is assembled from plural roll head rim parts by joints secured by screws. The rim parts forming the body 8 as well as the sector plates 7 are made from a suitable material such as steel, for instance. The blanket 3 is fixed to the roll head 4 by a clamp element 14 that supported by the body 8 compresses the lateral rim of the blanket against the inner rim surface 15 of sector plate 7. Into a locking slot of sector plate 7 is inserted a tongue 16 made to the lateral rim of the blanket, whereupon the blanket is locked to the sector plate by means of a pin-like locking element 10 inserted through the hole of the tongue 16. The locking element cooperates functionally with a gearwheel 11 by means of which the locking element can be moved in the radial direction of the roll head.

Figure 4:
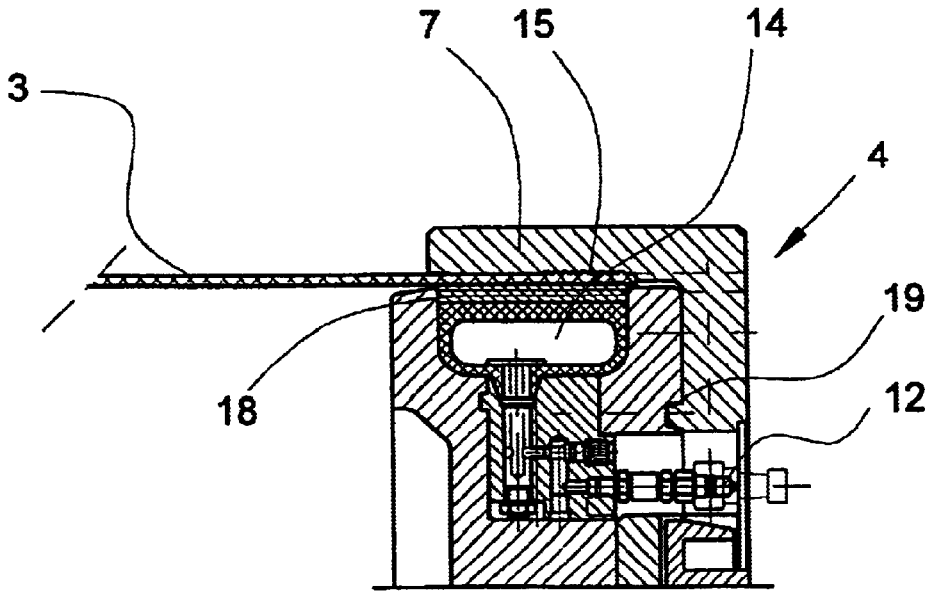
FIG. 4 is a sectional view of FIG. 2 taken along plane C—C.

FIG. 4 shows a partially sectional view of a roll head 4 with a clamp element 14 fitted in its interior space. The clamp element 14 comprises an annular hose-like, flexible element fillable with a pressurized medium. For pressurization and depressurization of the clamp element thereto are connected valve means 17 such that the end of the valve means extending exterior to the roll head is suited to accommodate a pressurization valve 12. The number of pressurization valves per roll head may be two, for example. Advantageously, the pressurization of the clamp element 14 is performed using a liquid medium. In the exemplary embodiment discussed herein, the number of pressurization valves 12 is two, whereby one of the valves can be used for purging air out from the interior of the clamp element during its pressurization while the pressurizing medium is being introduced into the clamp element via the other valve.

On the clamp element 14 is inserted an elastic ring 18 made from a suitable material such as hard rubber. During the pressurization of the clamp element 14, the clamp element 14 is compressed against clamp ring 18 that presses the blanket 3 against the inner rim surface 15 of sector plate 7. On the inner rim surface 15 of the sector plate 7 are machined annular grooves, whereby the lateral rim of the blanket will partially become compressed into the grooves thus undergoing axial clamping. At the depressurization of the clamp element, the elastic ring 18 constricts the clamp element, whereupon the blanket can be detached.

From FIG. 4 is also evident the locking of the sector plate radially to the roll end by means of an annularly wedged tongue-and-groove joint 19.

Figure 5:
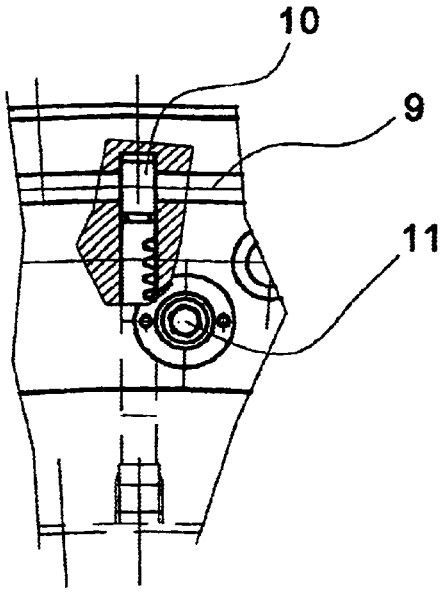
FIG. 5 is an enlarged detail view of a locking element.

In FIG. 5 is shown a partially sectional enlarged view of a locking element 10 with a gearwheel 11 functionally cooperating therewith. The shaft of the locking element is transversely toothed at a pitch mating with that of the gearwheel teeth. Then, rotation of the gearwheel, e.g., by means of an Allen key, allows the locking element to be moved in the radial direction of the roll head so that the locking element is withdrawn from the locking hole 9 or, as shown in the diagram, the tip of locking element 10 is driven via locking hole 9 as far as to enter a cavity 20 made to the opposite side of the locking hole.

Figure 6:
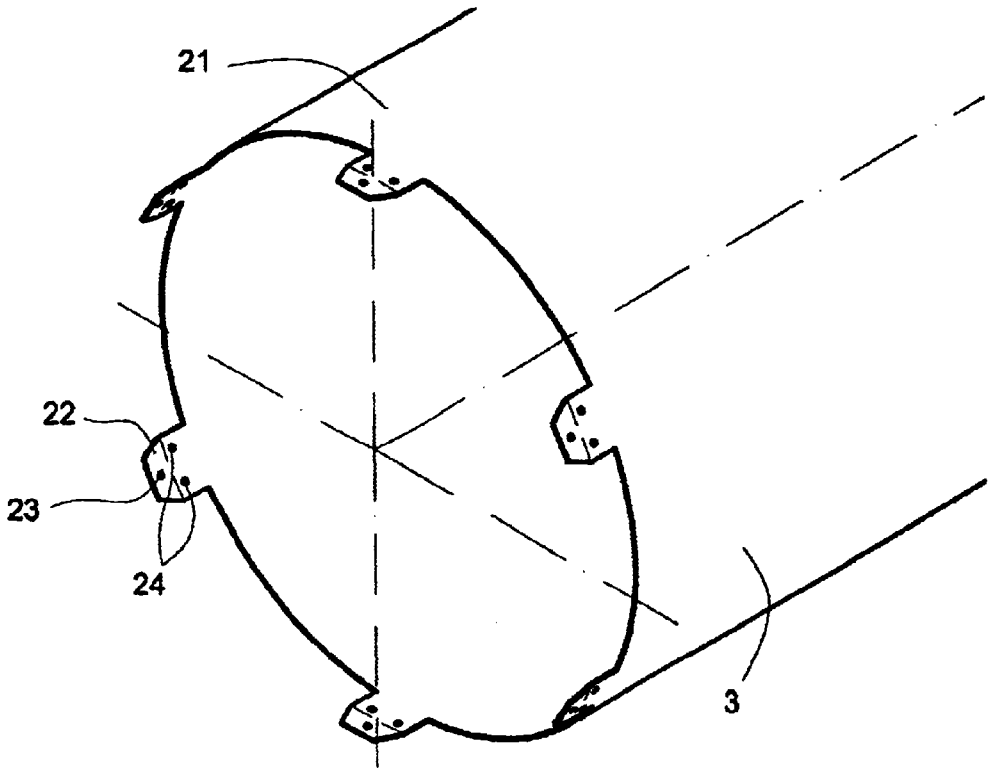
FIG. 6 is a perspective view of an endless-loop blanket used in a press roll according to the invention.

In FIG. 6 is shown in an exemplary fashion one lateral rim of the endless-loop blanket 3 used in a press roll according to the present invention. The lateral rim of the blanket comprises an edge portion 21 having tongues 22 extending axially from the blanket edge. The tongues include holes machined thereto so that the distal hole 23 can be used in the mounting of the blanket while the two proximal holes 24 located adjacent to each other serve for the locking of the blanket.

Figure 7:
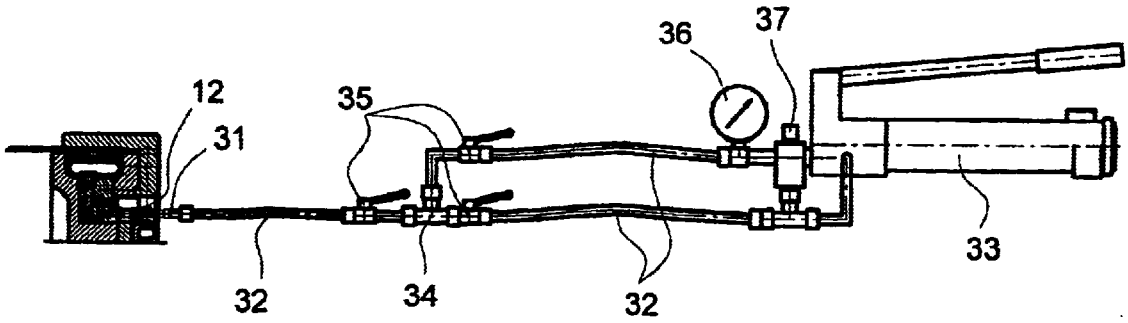
FIG. 7 is a schematic view of an arrangement for pressurizing the pressurized-medium-filled blanket clamp element.

In FIG. 7 is shown diagrammatically an exemplary embodiment of an arrangement for pressurizing a hose-like clamp member by a pressurized liquid medium. As described earlier in the text, the clamp element has connected thereto a pressurization valve 12 via which air contained in the interior of the clamp element can be removed while a liquid pressurizing medium is simultaneously introduced therein. As shown in the diagram, the pressurizing system comprises a union 31 for connecting the system to the pressurization valve 12, conduits 32 for passing the liquid pressurizing medium to the clamp element and air out therefrom, the conduits being connected to a manually operated pump 33 suited for carrying out the clamp element pressurizing and depressurizing steps. The pump is provided with bypass valves via which air possibly entrained in the conduits can be removed. The conduits that are connected to each other by a T-union 34 have cutout valves 35 by means of which the system can be operated so as to depressurize the clamp element and pressurize the same again in a controlled manner. The conduits are additionally provided with a manometer 36 for monitoring the pressurizing line pressure and a pressure-regulating valve 37 for limiting the line pressure to a desired maximum level if so required. Obviously, the pressurization and depressurization of the clamp element may also be carried out using other kind of pressurizing system such as an automatic pump connected to the clamp element.

Blanket replacement on the press roll according to the present invention is carried out as follows. The pressurizing system is first connected to the pressurization valve of the clamp element and the cutout valve at the roll head is opened. Next, the clamp element is depressurized, e.g., by means of the manual pressurization system described above. The toothed locking pins of the sector plates at the roll heads are released, whereupon the worn blanket can be removed. During the mounting of the new blanket, the most distal holes in the tongues of the blanket edge serve as tensioning points of the blanket. The tongues are inserted into the locking slots of the sector plates, whereupon the sector plates are locked again to the body of the roll head. The tongues are locked to the locking slots by the locking elements. Tongue portions overextending the locking slots are removed by cutting away the portion of the tongue material containing the most distal hole. The clamp element is pressurized by pumping the liquid pressurizing medium therein via the pressurization valve, whereby the elastic ring surrounding the clamp element presses the lateral rim of the blanket against the grooves made to the inner rim surface of the roll head so as to secure the blanket in a liquid-and air-tight fashion to the roll head.

It must be understood that the invention is not limited by the exemplary embodiment described above, but rather may be varied within the inventive spirit and scope of the appended claims.

What is claimed is:

1. A press roll (1) comprising a flexible rotating endless-loop blanket (3) of a liquid-impervious material, two disc-shaped roll heads (4, 5), and a clamp element (14) filled with a pressurized medium for clamping the lateral rims (21) of the blanket (3) to the respective ones (4,5) of the roll heads, wherein between the clamp element (14) and the blanket (3) is inserted an elastic annular ring (18) serving to press the rim of the blanket (3) during the pressurization of said clamp element (14) against an annular groove on an inner rim surface (15) of a sector plate (7) and, respectively, serving to contract the clamp element (14) when the inflating pressure of the clamp element (14) is removed or lowered.

2. The press roll of claim 1, wherein the blanket is arranged to be compressively sealed/clamped to the roll head against the annular groove.

3. The press roll of claim 1, wherein the clamp element (14) is an annular clamp means fillable with a pressurized liquid medium.

4. The press roll of claim 1, wherein the sector plate (7) is locked to the body of the roll head in the radial direction of the inner wall thereof by means of an annularly wedged tongue-and-groove joint (19).

5. The press roll of claim 1, wherein the roll head (4, 5) includes a clamp means (10) adapted movable in the radial direction of the roll head so as to cooperate with the endless-loop blanket for clamping the rim (21, 22) of the blanket to the roll head, said clamp means (10) comprising a gearwheel (11) rotatable from the exterior side of the roll head and a toothed locking pin cooperating with the teeth of the gearwheel so as to be movable in the radial direction of the roll head by means of said gearwheel for engaging the pin into a locking hole (9) and disengaging the pin from said locking hole.

6. A press roll (1) comprising a flexible rotating endless loop blanket (3) of a liquid-impervious material, two disc-shaped roll heads (4, 5), and a clamp element (14) filled with a pressurized medium for clamping the lateral rims (21) of the blanket (3) to the respective ones (4, 5) of the roll heads, wherein between the clamp element (14) and the blanket (3)

is inserted an elastic annular ring (18) serving to press the rim of the blanket (3) during the pressurization of the clamp element (14) against an inner rim surface (15) of a sector plate (7) and, respectively, serving to contract the clamp element (14) when the inflating 7) pressure of the clamp element (14) is removed or lowered, wherein the roll bead (4, 5) includes a clamp means (10) adapted movable in the radial direction of the roll head so as to cooperate with the blanket (3) for clamping the run (21, 22) of the blanket (3) to the roll head (4, 5).

* * * * *